US010163402B2

(12) United States Patent
Kamio et al.

(10) Patent No.: US 10,163,402 B2
(45) Date of Patent: Dec. 25, 2018

(54) IMAGE PROCESSING APPARATUS AND IMAGE PROCESSING METHOD

(71) Applicant: SONY CORPORATION, Tokyo (JP)

(72) Inventors: Kazunori Kamio, Kanagawa (JP); Takahiro Nagano, Kanagawa (JP); Yiwen Zhu, Kanagawa (JP); Hideyuki Ichihashi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 131 days.

(21) Appl. No.: 15/128,172

(22) PCT Filed: Mar. 17, 2015

(86) PCT No.: PCT/JP2015/057838
§ 371 (c)(1),
(2) Date: Sep. 22, 2016

(87) PCT Pub. No.: WO2015/151792
PCT Pub. Date: Oct. 8, 2015

(65) Prior Publication Data

US 2017/0103711 A1 Apr. 13, 2017

(30) Foreign Application Priority Data

Mar. 31, 2014 (JP) ..... 2014-073505

(51) Int. Cl.
*G09G 3/34* (2006.01)
*G09G 3/20* (2006.01)
(Continued)

(52) U.S. Cl.
CPC ..... *G09G 3/3406* (2013.01); *G09G 3/20* (2013.01); *G09G 3/30* (2013.01); *G09G 3/36* (2013.01);
(Continued)

(58) Field of Classification Search
CPC ..... G09G 2320/066; G09G 2330/021; G09G 2330/023; G09G 5/10; G09G 2320/0233; G09G 2360/16
See application file for complete search history.

(56) References Cited

U.S. PATENT DOCUMENTS

2001/0017619 A1* 8/2001 Takeuchi ..... G09G 5/10 345/204
2007/0097153 A1* 5/2007 Kong ..... G09G 5/14 345/690
(Continued)

FOREIGN PATENT DOCUMENTS

JP 05-012441 A 1/1993
JP 2001-119610 A 4/2001
(Continued)

OTHER PUBLICATIONS

Extended European Search Report of EP Patent Application No. 15772960.9, dated Nov. 7, 2017, 09 pages.
(Continued)

*Primary Examiner* — Sanjiv D Patel
(74) *Attorney, Agent, or Firm* — Chip Law Group

(57) ABSTRACT

The present disclosure relates to an image processing apparatus, an image processing method, and a program which can suppress degradation of image quality when power consumption of a display unit is reduced by reducing luminance of an image. A determining unit determines a reduction amount of luminance of a pixel based on characteristics of each pixel of an input image. A reducing unit reduces the luminance of the pixel of the input image by the reduction amount determined by the determining unit. The present disclosure can be applied to, for example, an image processing apparatus, or the like, which reduces luminance of a pixel based on characteristics of each pixel of an input
(Continued)

image and displays the input image whose luminance is reduced.

12 Claims, 12 Drawing Sheets

(51) Int. Cl.
*G09G 3/30* (2006.01)
*G09G 3/36* (2006.01)

(52) U.S. Cl.
CPC ..... *G09G 2320/0233* (2013.01); *G09G 2320/0271* (2013.01); *G09G 2320/0295* (2013.01); *G09G 2320/066* (2013.01); *G09G 2320/0626* (2013.01); *G09G 2330/021* (2013.01); *G09G 2360/16* (2013.01)

(56) References Cited

U.S. PATENT DOCUMENTS

2007/0115297 A1* 5/2007 Hirose ..... G06F 17/30905 345/597
2008/0062208 A1* 3/2008 Tada ..... G09G 3/2007 345/690
2010/0085285 A1* 4/2010 Ozawa ..... G09G 3/3233 345/77
2011/0007101 A1* 1/2011 Mori ..... G09G 3/3208 345/690
2011/0205442 A1* 8/2011 Mori ..... G09G 3/3208 348/673

FOREIGN PATENT DOCUMENTS

JP 2007-114579 A 5/2007
JP 2008-020502 A 1/2008
JP 2008-070496 A 3/2008
JP 2008-151921 A 7/2008
JP 2010-091719 A 4/2010
JP 2010-139944 A 6/2010
JP 2011-002520 A 1/2011
JP 2013-104912 A 5/2013

OTHER PUBLICATIONS

Office Action for JP Patent Application No. 2016-511514, dated Oct. 2, 2018, 07 pages of Office Action and 04 pages of English Translation.

* cited by examiner

IMAGE PROCESSING APPARATUS AND IMAGE PROCESSING METHOD

CROSS REFERENCE TO RELATED APPLICATIONS

This application is a U.S. National Phase of International Patent Application No. PCT/JP2015/057838 filed on Mar. 17, 2015, which claims priority benefit of Japanese Patent Application No. 2014-073505 filed in the Japan Patent Office on Mar. 31, 2014. Each of the above-referenced applications is hereby incorporated herein by reference in its entirety.

TECHNICAL FIELD

The present disclosure relates to an image processing apparatus, an image processing method, and a program, and, more particularly, to an image processing apparatus, an image processing method, and a program which can suppress degradation of image quality when power consumption of a display unit is reduced by reducing luminance of an image.

BACKGROUND ART

A technology for reducing power consumption of a display is an important technology in, particularly, a long period of use of battery-powered mobile equipment such as a smartphone and a tablet terminal. As a technology for reducing power consumption of a liquid crystal display (LCD), there is a technology of making luminance of a backlight as low as possible by making a value obtained through integration of a luminance value and luminance of the backlight approach to an observation value (see, for example, Patent Literature 1). However, this technology cannot be applied to a self-luminous display such as an organic light-emitting diode (OLED) display.

As a technology for reducing power consumption of a self-luminous display, there is a technology of reducing luminance by uniformly multiplying luminance of an image by a gain less than 1, or a technology of reducing luminance of a region having predetermined characteristics (see, for example, Patent Literature 2).

However, with the technology of reducing luminance by uniformly multiplying luminance of an image by a gain less than 1, an image wholly becomes dark. Further, with the technology of reducing luminance of a region having predetermined characteristics, because a reduction amount of luminance cannot be finely controlled, image quality degrades.

Further, although there is a technology of controlling a tone curve as a technology for reducing power consumption of a self-luminous display, contrast of the whole screen becomes too high.

CITATION LIST

Patent Literature

Patent Literature 1: JP 2013-104912A
Patent Literature 2: JP 2011-2520A

SUMMARY OF INVENTION

Technical Problem

As described above, when power consumption of a display unit is reduced by reducing luminance of an image, image quality degrades.

The present disclosure has been made in view of such circumstances, and is directed to suppressing degradation of image quality when power consumption of a display unit is reduced by reducing luminance of an image.

Solution to Problem

According to an aspect of the present disclosure, there is provided an image processing apparatus including a determining unit configured to determine a reduction amount of luminance of a pixel based on characteristics of each pixel of an image, and a reducing unit configured to reduce the luminance of the pixel by the reduction amount determined by the determining unit.

An image processing method and a program according to one aspect of the present disclosure correspond to the image processing apparatus according to one aspect of the present disclosure.

In one aspect of the present disclosure, a reduction amount of luminance of a pixel is determined based on characteristics of each pixel of an image, and the luminance of the pixel is reduced by the determined reduction amount.

Advantageous Effects of Invention

According to one aspect of the present disclosure, it is possible to reduce luminance. Further, according to one aspect of the present disclosure, when power consumption of a display unit is reduced by reducing luminance of an image, it is possible to suppress degradation of image quality.

Note that advantageous effects of the present disclosure are not necessarily limited to those described here, and may be any advantageous effect described in the present disclosure.

DESCRIPTION OF EMBODIMENTS

Assumption of the present disclosure and embodiments of the present disclosure (hereinafter, referred to as embodiments) will be described below. Note that description will be provided in the following order.

1. First Embodiment: Image Processing Apparatus (FIG. 1 to FIG. 4)
2. Second Embodiment: Image Processing Apparatus (FIG. 5 to FIG. 11)
3. Third Embodiment: Image Processing Apparatus (FIG. 12 and FIG. 13)
4. Fourth Embodiment: Computer (FIG. 14)
5. Fifth Embodiment: Television Apparatus (FIG. 15)
6. Sixth Embodiment: Mobile Phone (FIG. 16)
7. Seventh Embodiment: Recording/Reproducing Apparatus (FIG. 17)
8. Eighth Embodiment: Imaging Apparatus (FIG. 18)

<First Embodiment>

(Configuration Example of First Embodiment of Image Processing Apparatus)

Figure 1:
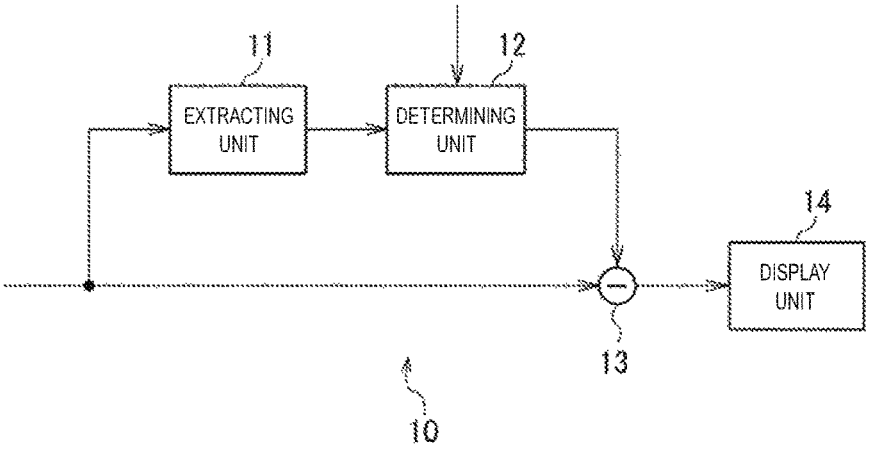
FIG. 1 is a block diagram illustrating a configuration example of a first embodiment of an image processing apparatus to which the present disclosure is applied.

FIG. 1 is a block diagram illustrating a configuration example of a first embodiment of an image processing apparatus to which the present disclosure is applied.

The image processing apparatus 10 in FIG. 1 is configured with an extracting unit 11, a determining unit 12, a reducing unit 13 and a display unit 14. The image processing apparatus 10 reduces power consumption of the display unit 14 by reducing luminance of an image input from outside (hereinafter, referred to as an input image).

Specifically, the extracting unit 11 of the image processing apparatus 10 extracts characteristics of each pixel of the input image. The characteristics of each pixel of the input image include contrast, luminance, color, positional relationship with a region of interest, a position within a screen, a motion amount, a band, an edge level of the pixel, or the like. The positional relationship of the pixel with the region of interest indicates whether the pixel is located within the region of interest. Further, the edge level indicates a degree the pixel is in an edge region or a texture region, which is determined based on a high frequency component. The extracting unit 11 supplies the extracted characteristics of each pixel to the determining unit 12.

The determining unit 12 determines a reduction amount of luminance of the input image based on the characteristics supplied from the extracting unit 11 and metadata relating to display of an image to be input from outside, for each pixel of the input image.

The metadata includes a remaining battery level of a battery (not illustrated) which supplies power to the display unit 14, an external light amount, a brightness adjustment mode, a type of application which executes display of an input image, elapsed time of display of an input image since a user performs operation last, a display direction, a display position in a screen, background color, letter color, or the like. The brightness adjustment mode includes strong, medium and weak modes in descending order of an allowable range according to the allowable range of change of the luminance of an input image. The determining unit 12 supplies a reduction amount of each pixel to the reducing unit 13.

The reducing unit 13 reduces the luminance of the input image by the reduction amount supplied from the determining unit 12 for each pixel of the input image. The reducing unit 13 supplies the input image in which the luminance of each pixel is reduced to the display unit 14 as an output image.

The display unit 14 displays the output image supplied from the reducing unit 13. Because the luminance of each pixel of the output image is less than luminance of each pixel of the input image, the display unit 14 consumes less power when displaying the output image than when displaying the input image.

(First Example of Reduction Amount)

Figure 2:
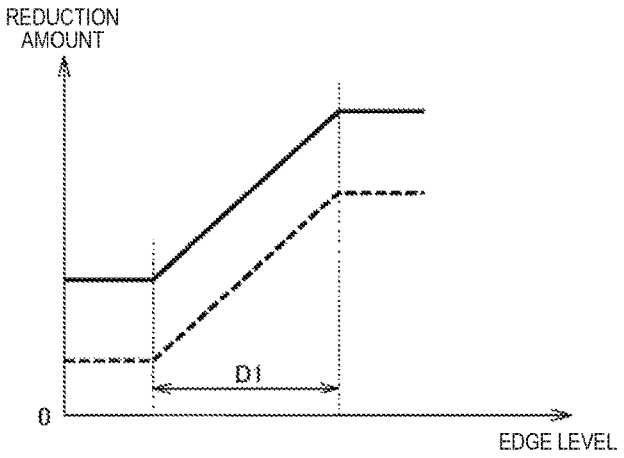
FIG. 2 is a diagram illustrating a first example of a reduction amount when characteristics of each pixel of an input image is an edge level according to one embodiment of the present disclosure.

FIG. 2 is a diagram illustrating a first example of a reduction amount when characteristics of each pixel of the input image is an edge level.

FIG. 2 illustrates an edge level on a horizontal axis and illustrates a reduction amount on a vertical axis. Further, a solid line indicates a reduction amount when the remaining battery level as metadata is low, and a dashed line indicates a reduction amount when the remaining battery level is high. This will also apply in FIG. 3 which will be described later.

In the example in FIG. 2, the reduction amount is determined so as to be larger as the edge level becomes higher in a range D1 and so as to be constant outside the range D1. Further, the reduction amount is determined so as to be larger by a predetermined amount in the case where the remaining battery level is low than in the case where the remaining battery level is high.

Accordingly, a reduction amount in an edge region or a texture region in which change of the luminance within the input image is not prominent is larger than a reduction amount in a flat region in which change of the luminance is prominent. Further, a reduction amount is larger when the remaining battery level is low, and when it is necessary to further reduce power consumption of the display unit 14 than in the case where the remaining battery level is high.

(Second Example of Reduction Amount)

Figure 3:
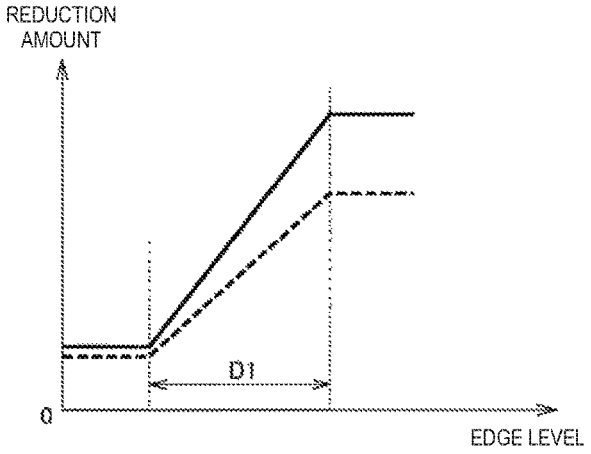
FIG. 3 is a diagram illustrating a second example of a reduction amount when characteristics of each pixel of an input image is an edge level according to one embodiment of the present disclosure.

FIG. 3 is a diagram illustrating a second example of a reduction amount when characteristics of each pixel of an input image is an edge level.

In the example in FIG. 3, as with the case of FIG. 2, the reduction amount is determined so as to be larger as the edge level is higher in the range D1 and so as to be constant outside the range D1. However, a difference in the reduction amount according to the remaining battery level is made larger as the edge level is higher in the range D1. Further, a difference in the reduction amount according to the remaining battery level in a pixel having an edge level below the range D1 is smaller than a difference in a pixel having an edge level above than the range D1.

Also in the case of FIG. 3, as with the case in FIG. 2, a reduction amount in the edge region or the texture region in which change of the luminance within the input image is not prominent is larger than the flat region in which change of the luminance is prominent. Further, the reduction amount is larger when the remaining battery level is low, and when it is necessary to further reduce power consumption of the display unit 14 than in the case where the remaining battery level is high.

As described above, when the characteristics of each pixel of the input image is an edge level, and the metadata is a remaining battery level, in the output image of the image processing apparatus 10, a flat region is brighter than an image whose luminance is reduced by uniformly multiplying the luminance of the image by a gain less than 1. Therefore, the image has a bright overall impression. Further, in the output image of the image processing apparatus 10, the texture region and the edge region are darker than the image whose luminance is reduced by uniformly multiplying the luminance of the image by a gain less than 1. Therefore, the texture region and the edge region are seen clear.

Note that, while, in FIG. 2 and FIG. 3, a case has been described where the characteristics of each pixel of the input image is an edge level and the metadata is a remaining battery level, in the case of other characteristics and metadata, a reduction amount is determined based on the other characteristics and metadata in a similar manner.

For example, the reduction amount is made larger when contrast is higher, luminance is lower, color is brighter, positional relationship with a region of interest indicates that a pixel is located outside the region of interest, the pixel is located in a lower part within a screen, or the pixel has a smaller motion amount, that is, change of luminance is less likely to be prominent in the pixel, as the characteristics of each pixel of the input image. Further, for example, the reduction amount is made larger when the external light amount is small or the brightness adjustment mode is set at strong as the metadata.

(Explanation of Processing of Image Processing Apparatus)

Figure 4:
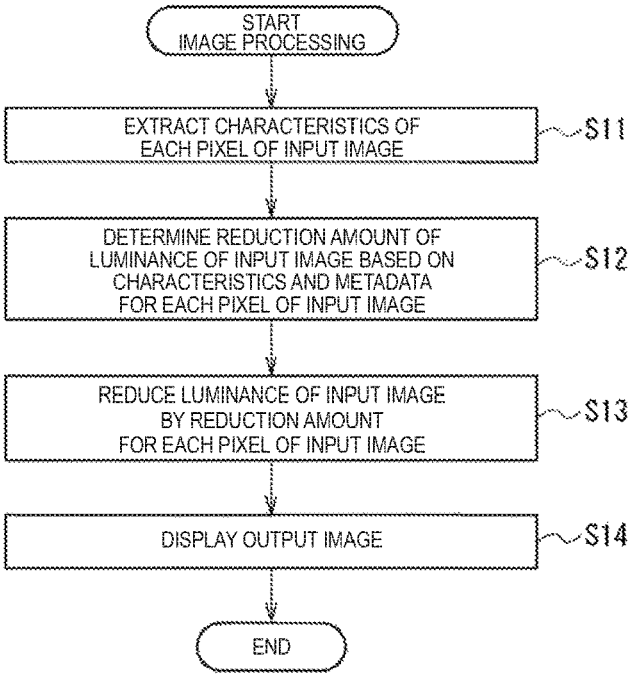
FIG. 4 is a flowchart explaining image processing of the image processing apparatus in FIG. 1.

FIG. 4 is a flowchart explaining image processing of the image processing apparatus 10 in FIG. 1. This image processing is started, for example, when the input image is input to the image processing apparatus 10.

In step S11 in FIG. 4, the extracting unit 11 of the image processing apparatus 10 extracts characteristics of each pixel of the input image and supplies the extracted characteristics of each pixel to the determining unit 12.

In step S12, the determining unit 12 determines a reduction amount of the luminance of the input image based on the characteristics supplied from the extracting unit 11 and the metadata input from outside for each pixel of the input image. The determining unit 12 supplies the reduction amount of each pixel to the reducing unit 13.

In step S13, the reducing unit 13 reduces the luminance of the input image by the reduction amount supplied from the determining unit 12 for each pixel of the input image. The reducing unit 13 supplies the input image in which the luminance of each pixel is reduced to the display unit 14 as an output image.

In step S14, the display unit 14 displays the output image supplied from the reducing unit 13. Then, the processing ends.

As described above, the image processing apparatus 10 determines the reduction amount based on the characteristics of the pixel for each pixel of the input image and reduces the luminance by the reduction amount. Therefore, the image processing apparatus 10 can suppress degradation of image quality of the output image by decreasing the reduction amount corresponding to the characteristics of a pixel in which change of the luminance is prominent. Further, because the image processing apparatus 10 displays the output image in which the luminance of each pixel of the input image is reduced at the display unit 14, it is possible to reduce power consumption of the display unit 14. That is, the image processing apparatus 10 can suppress degradation of image quality when power consumption of the display unit is reduced by reducing the luminance of the input image.

Note that the reducing unit 13 may reduce the luminance according to an operation mode of the image processing apparatus 10. For example, the reducing unit 13 may reduce the luminance only when the operation mode is a mode for reducing power consumption of the display unit 14. The operation mode can be, for example, set by the user, or determined according to the remaining battery level.

Further, the determining unit 12 may determine the reduction amount for each block constituted with a plurality of pixels instead of determining the reduction amount for each pixel.

<Second Embodiment>

(Configuration Example of Second Embodiment of Image Processing Apparatus)

Figure 5:
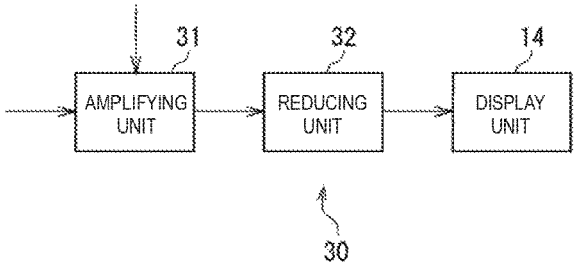
FIG. 5 is a block diagram illustrating a configuration example of a second embodiment of the image processing apparatus to which the present disclosure is applied.

FIG. 5 is a block diagram illustrating a configuration example of a second embodiment of the image processing apparatus to which the present disclosure is applied.

Among components illustrated in FIG. 5, the same reference numerals are assigned to the components which are the same as the components in FIG. 1. Overlapped explanation will be omitted as appropriate.

The image processing apparatus 30 in FIG. 5 is configured with an amplifying unit 31, a reducing unit 32 and a display unit 14. The image processing apparatus 30 reduces power consumption of the display unit 14 by reducing the luminance of the input image after amplifying alternating current (AC) components of the luminance of the input image.

Specifically, the amplifying unit 31 of the image processing apparatus 30 compensates for the AC components by amplifying the AC components of the luminance of the input image with an amplification gain based on the metadata regarding display of the input image input from outside.

As a method for amplifying the AC components, there are, for example, a first method of amplifying AC components using a quadratic differential filter, a second method of amplifying AC components while adjusting an amplification gain based on polarity of a quadratic differential of the input image, a third method of adjusting a correction amount based on a first differential waveform of the input image, or the like. The metadata is, for example, the same as the metadata in the first embodiment. The amplifying unit 31 supplies the input image whose AC components are amplified to the reducing unit 32.

The reducing unit 32 reduces the luminance by uniformly multiplying the luminance of the input image supplied from the amplifying unit 31 by a gain less than 1. The reducing unit 32 supplies the input image whose luminance is reduced to the display unit 14 as an output image.

(Example of Amplification Gain)

Figure 6:
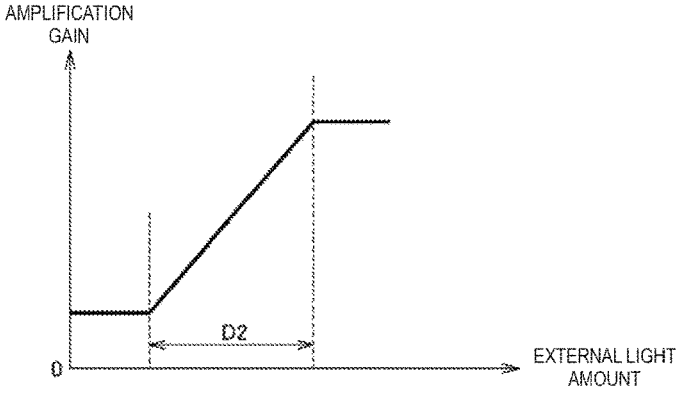
FIG. 6 is a diagram illustrating an example of an amplification gain when metadata is an external light amount according to one embodiment of the present disclosure.

FIG. 6 is a diagram illustrating an example of the amplification gain when the metadata is an external light amount.

FIG. 6 illustrates the external light amount on a horizontal axis and illustrates the amplification gain on a vertical axis.

As illustrated in FIG. 6, the amplification gain is determined so as to be larger when the external light amount is larger in a range D2 and so as to be constant outside the range D2. Therefore, the amplification gain becomes larger when the external light amount is large and visibility of the output image is poor than in the case where the external light amount is small and visibility of the output image is favorable.

Note that, while a case has been described in FIG. 6 where the metadata is an external light amount, also in the case of other metadata, the amplification gain is determined based on the other metadata in a similar manner.

(Example of Input Image Whose AC Components are Amplified)

Figure 7:
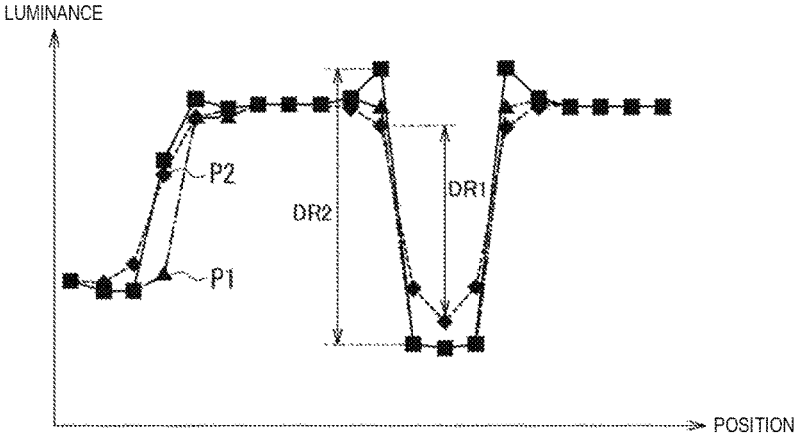
FIG. 7 is a diagram illustrating an example of an input image whose AC component is amplified according to one embodiment of the present disclosure.

FIG. 7 is a diagram illustrating an example of the input image whose AC components are amplified.

FIG. 7 illustrates positions of pixels in a horizontal direction on a horizontal axis and illustrates luminance of the pixels on a vertical axis. Further, a dashed line in FIG. 7 indicates the luminance of the input image whose AC components are amplified using an amplifying method in which overshoot is not provided, and a solid line indicates the luminance of the input image whose AC components are amplified using the first method. A dashed-dotted line in FIG. 7 indicates luminance of the input image whose AC components are amplified using the second or the third method.

A dynamic range DR2 in the edge region of the input image amplified using the first method as indicated with the solid line in FIG. 7 is larger than a dynamic range DR1 in the edge region of the input image amplified using the amplifying method in which overshoot is not provided as indicated with the dashed line in FIG. 7. Therefore, the amplifying unit 31 can increase contrast of the edge region of the input image compared to the method in which overshoot is not provided by performing amplification using the first method. However, when amplification is performed using the first method, because maximum luminance in the edge region becomes higher than in the case where amplification is performed using the method in which overshoot is not provided, power consumption of the display unit 14 becomes larger.

On the other hand, luminance P1 in the edge region of the input image amplified using the second or the third method as indicated with the dashed-dotted line in FIG. 7 is lower than luminance P2 in the edge region of the input image amplified using the amplifying method in which overshoot is not provided as indicated with the dashed line in FIG. 7. Therefore, the amplifying unit 31 can reduce power consumption of the display unit 14 by performing amplification using the second or the third method compared to using the method in which overshoot is not provided.

Further, inclination of luminance in the edge region of the input image amplified using the second or the third method as indicated with the dashed-dotted line in FIG. 7 is steeper than inclination of luminance in the edge region of the input image amplified using the amplifying method in which overshoot is not provided as indicated with the dashed line in FIG. 7. Therefore, the amplifying unit 31 can increase contrast by performing amplification using the second or the third method compared to using the method in which overshoot is not provided.

(Explanation of Effects)

Figure 8:
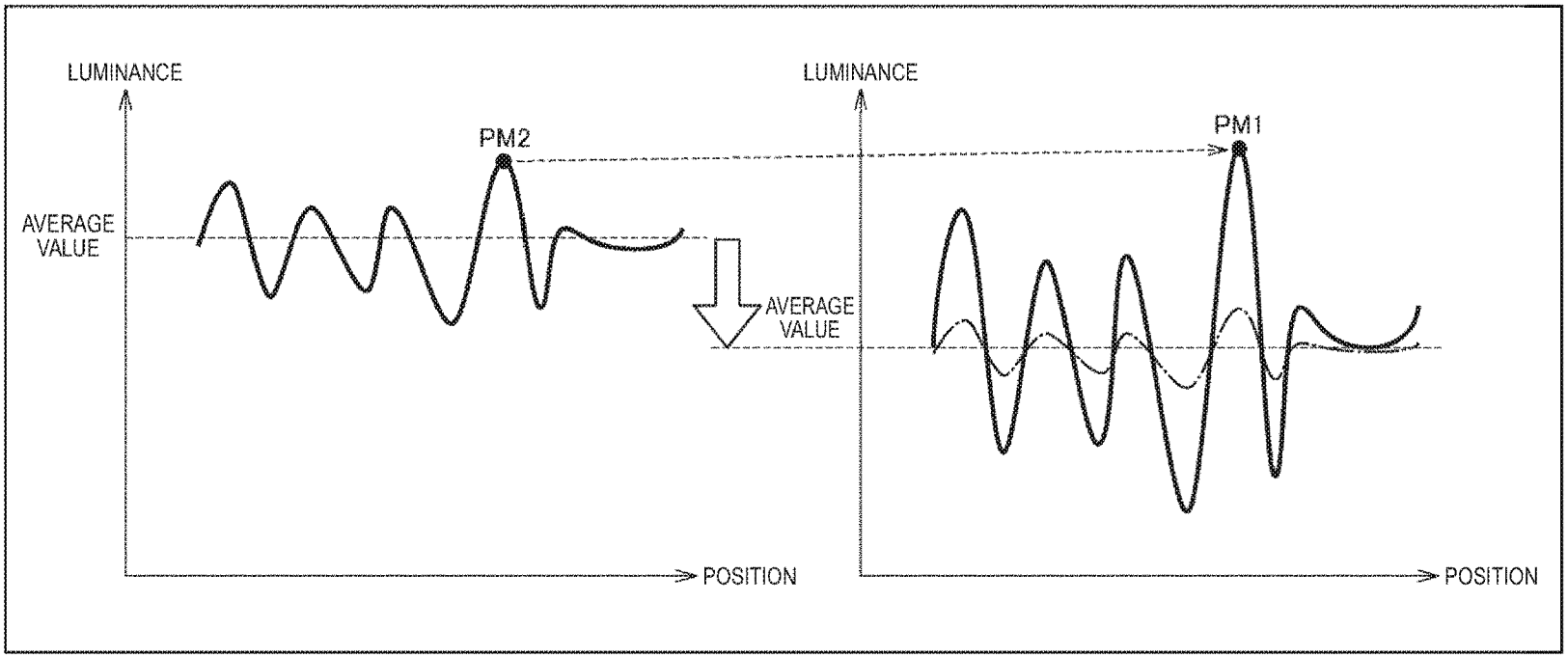
FIG. 8 is a diagram illustrating principle of an effect of an image processing apparatus according to one embodiment of the present disclosure.

FIG. 8 is a diagram illustrating principle of effects of the image processing apparatus 30.

FIG. 8 illustrates positions of pixels arranged in a horizontal direction on a horizontal axis and illustrates luminance of the pixels on a vertical axis.

When the luminance is reduced by uniformly multiplying the luminance by a gain less than 1 without amplifying AC components of the luminance in the texture region of the input image indicated with the solid line in a left part of FIG. 8, an image after the luminance is reduced is as indicated with a dashed-dotted line in FIG. 8. That is, in this case, while an average value which is DC components of the luminance of the input image decreases by multiplication by a gain less than 1, a local dynamic range which is AC components also decreases. As a result, while power consumption of the display unit 14 is reduced, contrast is reduced.

On the other hand, an output image generated from the texture region of the input image indicated with the solid line in the left part of FIG. 8 becomes as indicated with the solid line in the right part in FIG. 8. That is, in this case, while an average value which is DC components of the luminance of the input image decreases by multiplication by a gain less than 1, a local dynamic range which is AC components is compensated for by amplification of the AC components. As a result, while power consumption of the display unit 14 is reduced, reduction in local contrast is suppressed.

In the example of FIG. 8, because the amplification gain is larger than a gain upon reduction, the local dynamic range is larger than that of the input image. Therefore, local contrast of the output image is higher than that of the input image. Further, in the example of FIG. 8, maximum luminance PM1 of the output image is higher than maximum luminance PM2 of the input image.

Figure 9:
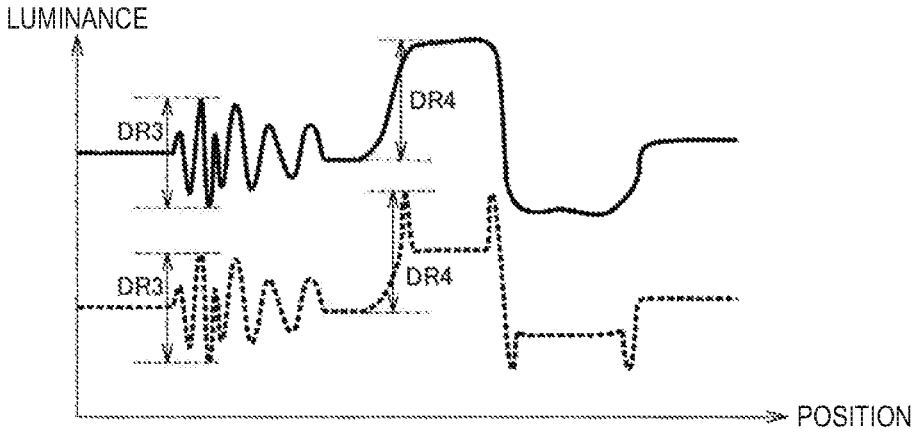
FIG. 9 is a diagram illustrating an example of luminance of an input image and an output image according to one embodiment of the present disclosure.

From the above-described principle, the output image generated for a certain input image becomes, for example, as illustrated in FIG. 9. That is, in the texture region indicated with a waveform in the left part of FIG. 9, an output image indicated with a dotted line in FIG. 9 in which a local dynamic range DR3 of the luminance is substantially the same as that of the input image, but an average value of the luminance is small is generated with respect to the input image indicated with a solid line in FIG. 9.

Further, in the example of FIG. 9, AC components of the luminance of the input image are amplified using the first method, and in the edge region indicated with a waveform in the right part of FIG. 9, an output image indicated with a dotted line in FIG. 9, in which overshoot is provided is generated with respect to the input image indicated with a solid line in FIG. 9. Therefore, also in the edge region, a dynamic range DR4 of the luminance is substantially the same as that of the input image. Accordingly, in this case, while power consumption of the display unit 14 is reduced, contrast is not reduced.

Note that, while not illustrated in the drawings, when the AC components of the luminance of the input image are amplified using the second or the third method, although a dynamic range of luminance in an edge region of an output image does not become the same as that of the input image, because inclination of the edge region becomes steep, contrast is not reduced as with the first method.

Figure 10:
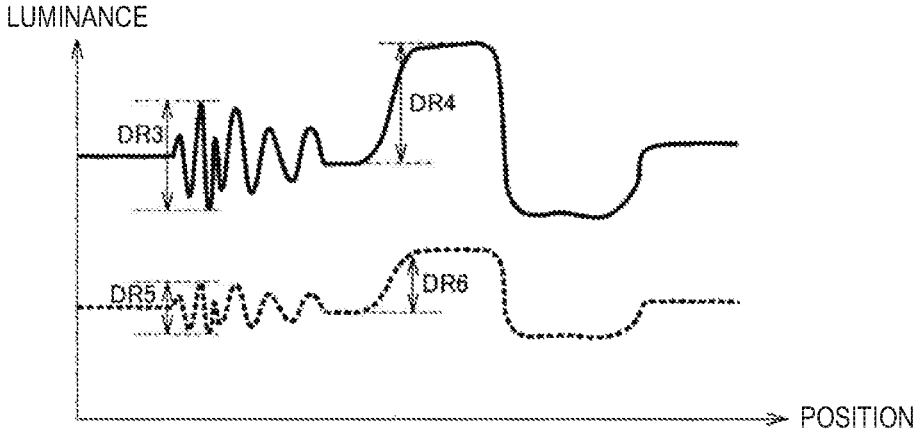
FIG. 10 is a diagram illustrating an example of luminance of an input image after an input image and luminance are uniformly reduced according to one aspect of the present disclosure.

On the other hand, an image in which luminance is reduced by uniformly multiplying the luminance by a gain less than 1 without amplifying the AC components of the luminance for the input image indicated with the solid line in FIG. 9, is as indicated with, for example, the dashed line in FIG. 10. Note that the solid line in FIG. 10 is the same as the solid line in FIG. 9 and indicates the input image.

As indicated with the dashed line in FIG. 10, the input image after the luminance is uniformly reduced has a smaller average value of luminance than that of the input image indicated with the solid line in FIG. 10. However, a local dynamic range DR5 in the texture region and a local dynamic range DR6 in the edge region of the input image after the luminance is uniformly reduced are also smaller than a local dynamic range DR3 in the texture region and a local dynamic range DR4 in the edge region of the input image. Therefore, in this case, while power consumption of the display unit 14 is reduced, contrast is also reduced.

(Explanation of Processing of Image Processing Apparatus)

Figure 11:
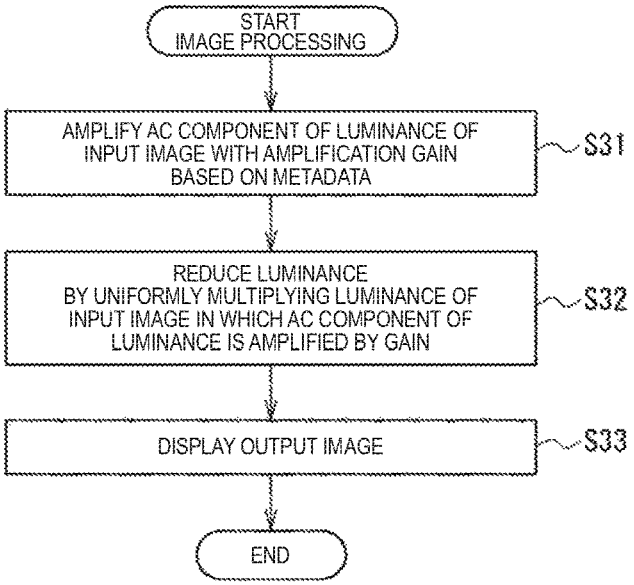
FIG. 11 is a flowchart explaining image processing of the image processing apparatus in FIG. 5.

FIG. 11 is a flowchart explaining image processing of the image processing apparatus 30 in FIG. 5. This image processing is started, for example, when an input image is input to the image processing apparatus 30.

In step S31 in FIG. 11, the amplifying unit 31 of the image processing apparatus 30 compensates for the AC components by amplifying the AC components of the luminance of the input image with an amplification gain based on the metadata input from outside. The amplifying unit 31 supplies the input image in which the AC components of the luminance are amplified to the reducing unit 32.

In step S32, the reducing unit 32 reduces the luminance by uniformly multiplying the luminance of the input image which is supplied from the amplifying unit 31 and in which the AC components of the luminance are amplified, by a gain less than 1. The reducing unit 32 supplies the input image whose luminance is reduced to the display unit 14 as an output image.

In step S33, the display unit 14 displays the output image supplied from the reducing unit 32. Then, the processing ends.

As described above, the image processing apparatus 30 amplifies the AC components of the luminance of the input image and uniformly reduces the amplified luminance of the input image with a gain less than 1. It is therefore possible to reduce power consumption of the display unit 14. Further, it is possible to suppress degradation of local contrast due to reduction of the luminance and further improve contrast.

Note that the image processing apparatus 30 may compensate for the AC components of the luminance and reduce the luminance according to the operation mode of the image processing apparatus 30. For example, when the operation mode is a mode for reducing power consumption of the display unit 14, it is also possible to make the amplifying unit 31 compensate for the AC components of the luminance and make the reducing unit 32 reduce the luminance. The operation mode can be, for example, set by the user or determined according to the remaining battery power.

<Third Embodiment>

(Configuration Example of Third Embodiment of Image Processing Apparatus)

Figure 12:
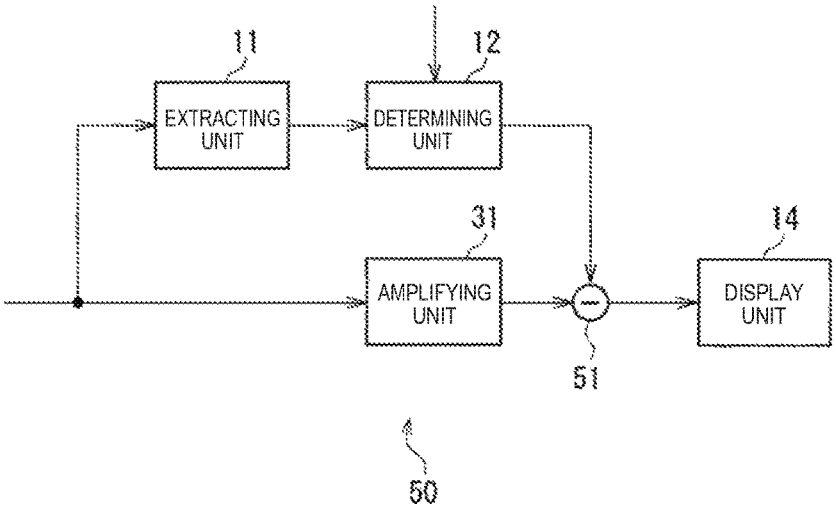
FIG. 12 is a block diagram illustrating a configuration example of a third embodiment of the image processing apparatus to which the present disclosure is applied.

FIG. 12 is a block diagram illustrating a configuration example of a third embodiment of the image processing apparatus to which the present disclosure is applied.

Among the components illustrated in FIG. 12, the same reference numerals are assigned to the components which are the same as the components in FIG. 1 or FIG. 5. Overlapped explanation will be omitted as appropriate.

The configuration of the image processing apparatus 50 in FIG. 12 is different from the configuration in FIG. 1 in that an amplifying unit 31 and a reducing unit 51 are provided in place of the reducing unit 13. The image processing apparatus 50 is a combination of the image processing apparatus 10 and the image processing apparatus 30, and reduces the luminance of the input image in which the AC components of the luminance are amplified by a reduction amount for each pixel of the input image.

Specifically, the reducing unit 51 of the image processing apparatus 50 reduces the luminance of each pixel of the input image in which the AC components of the luminance are amplified by the amplifying unit 31 by a reduction amount of the pixel determined by the determining unit 12. The reducing unit 51 supplies the input image in which the luminance is reduced to the display unit 14 as an output image.

(Explanation of Processing of Image Processing Apparatus)

Figure 13:
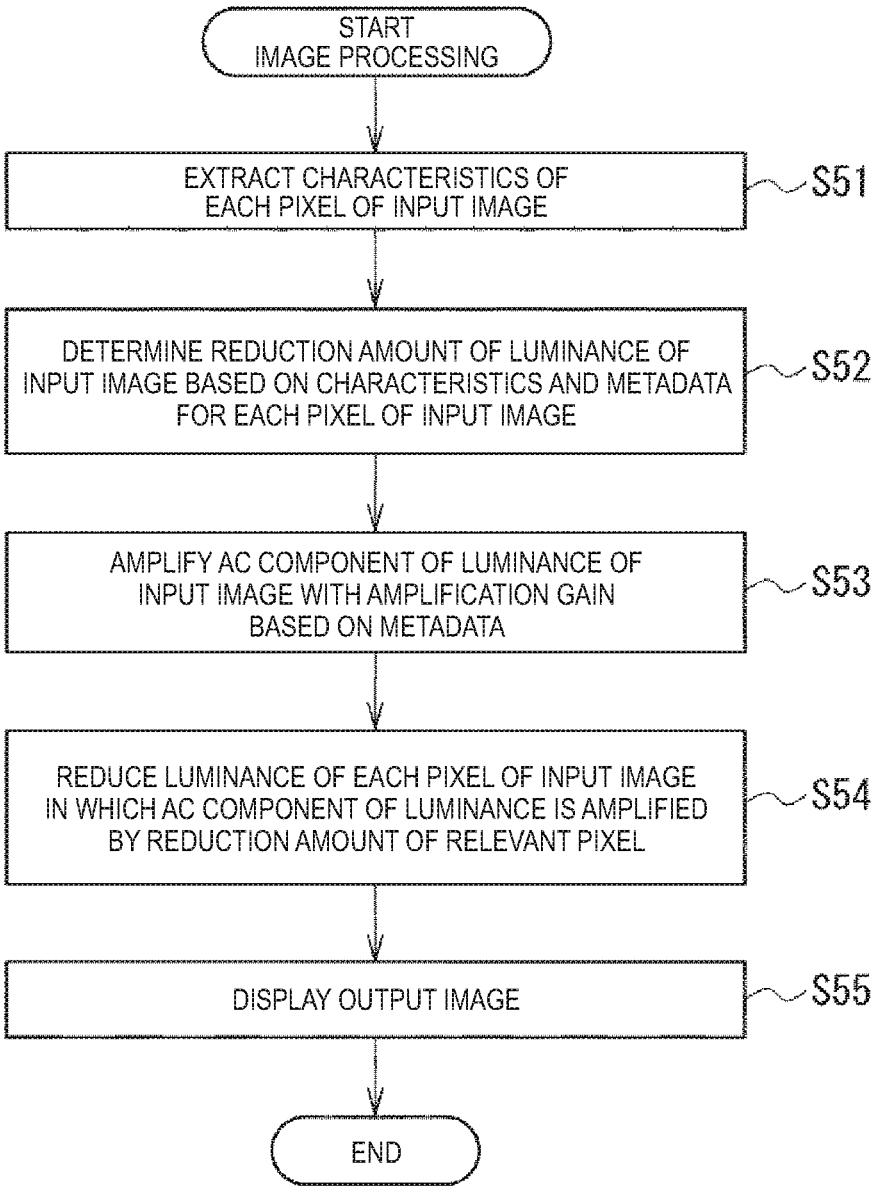
FIG. 13 is a flowchart explaining image processing of the image processing apparatus in FIG. 12.

FIG. 13 is a flowchart explaining image processing of the image processing apparatus 50 in FIG. 12. This image processing is, for example, started when an input image is input to the image processing apparatus 50.

In step S51 in FIG. 13, the extracting unit 11 of the image processing apparatus 50 extracts characteristics of each pixel of the input image and supplies the extracted characteristics of each pixel to the determining unit 12.

In step S52, the determining unit 12 determines a reduction amount of the luminance of the input image based on the characteristics supplied from the extracting unit 11 and the metadata input from outside for each pixel of the input image. The determining unit 12 supplies the reduction amount of each pixel to the reducing unit 51.

In step S53, the amplifying unit 31 compensates for AC components by amplifying the AC components of the luminance of the input image with an amplification gain based on the metadata input from outside. The amplifying unit 31 supplies the input image in which the AC components of the luminance are amplified to the reducing unit 51.

In step S54, the reducing unit 51 reduces the luminance of each pixel of the input image which is supplied from the amplifying unit 31 and in which the AC components of the luminance are amplified by the reduction amount of the pixel supplied from the determining unit 12. The reducing unit 51 supplies the input image in which the luminance is reduced to the display unit 14 as an output image.

In step S55, the display unit 14 displays the output image supplied from the reducing unit 51. Then, the processing ends.

As described above, the image processing apparatus 50 amplifies the AC components of the luminance of the input image and reduces the luminance of each pixel of the amplified input image by the reduction amount based on the characteristics of the pixel. Therefore, the image processing apparatus 50 can suppress degradation of image quality of the output image as with the image processing apparatus 10. Further, the image processing apparatus 50 can suppress decrease in local contrast due to reduction in the luminance and further improve contrast as with the image processing apparatus 30. Still further, the image processing apparatus 50 can suppress power consumption of the display unit 14 as with the image processing apparatus 10 and the image processing apparatus 30.

Note that a signal system of the input image is not particularly limited if a pixel value corresponds to the luminance. The input image can be made, for example, an RGB signal, an YCbCr signal and a YUV signal.

<Fourth Embodiment>

(Explanation of Computer to which the Present Disclosure is Applied)

The above-described series of processing can be executed with hardware such as large scale integration (LSI) or can be executed with software. When the series of processing is executed with software, a program configuring the software is installed in a computer. Here, the computer includes, for example, a computer incorporated into dedicated hardware, a general-purpose personal computer which can execute various kinds of functions by various kinds of programs being installed, or the like.

Figure 14:
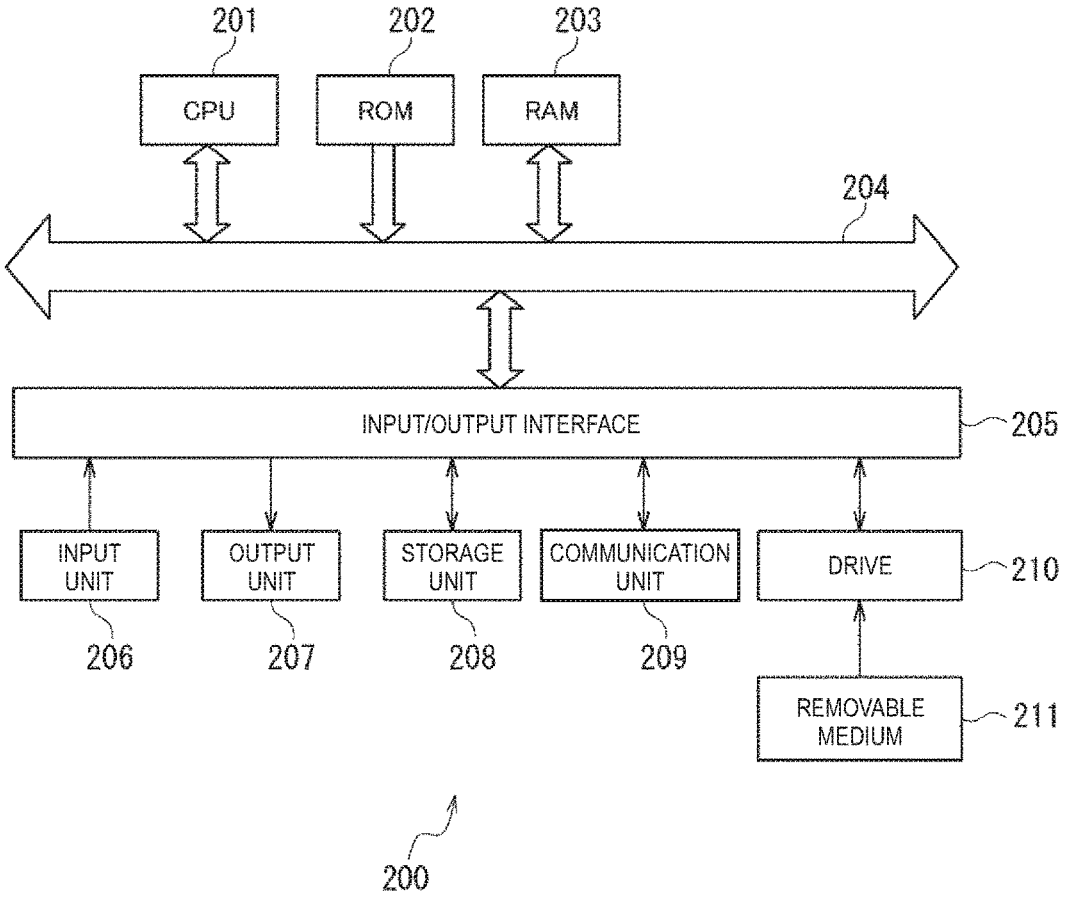
FIG. 14 is a block diagram illustrating a configuration example of hardware of a computer according to one embodiment of the present disclosure.

FIG. 14 is a block diagram illustrating a configuration example of hardware of a computer executing the above-described series of processing using a program.

In a computer 200, a central processing unit (CPU) 201, a read only memory (ROM) 202 and a random access memory (RAM) 203 are connected to one another through a bus 204.

An input/output interface 205 is further connected to the bus 204. An input unit 206, an output unit 207, a storage unit 208, a communication unit 209 and a drive 210 are connected to the input/output interface 205.

The input unit 206 is configured with a keyboard, a mouse, a microphone, or the like. The output unit 207 is configured with a display, a speaker, or the like. The storage unit 208 is configured with a hard disk, a non-volatile memory, or the like. The communication unit 209 is configured with a network interface, or the like. The drive 210 drives a removable medium 211 such as a magnetic disk, an optical disk, a magnetooptical disk and a semiconductor memory.

In the computer 200 configured as described above, the above-described series of processing is performed by, for example, the CPU 201 loading the program stored in the storage unit 208 to the RAM 203 through the input/output interface 205 and the bus 204 and executing the program.

The program executed by the computer 200 (CPU 201) can be provided by, for example, being recorded in the removable medium 211 as a package medium, or the like. Further, the program can be provided via a wired or wireless transmission medium such as a local area network, the Internet and digital satellite broadcasting.

In the computer 200, the program can be installed in the storage unit 208 via the input/output interface 205 by the removable medium 211 being mounted to the drive 210. Further, the program can be received at the communication unit 209 through a wired or wireless transmission medium and installed in the storage unit 208. In addition, the program can be installed in the ROM 202 or the storage unit 208 in advance.

Note that the program executed by the computer 200 may be a program which causes processing to be performed in chronological order according to the order described in the present specification, or may be a program which causes processing to be performed in parallel or at a necessary timing such as upon invocation of the program.

Further, when the computer 200 has a graphics processing unit (GPU), the above-described processing may be performed by the GPU instead of being performed by the CPU 201.

<Fifth Embodiment>

(Configuration Example of Television Apparatus)

Figure 15:
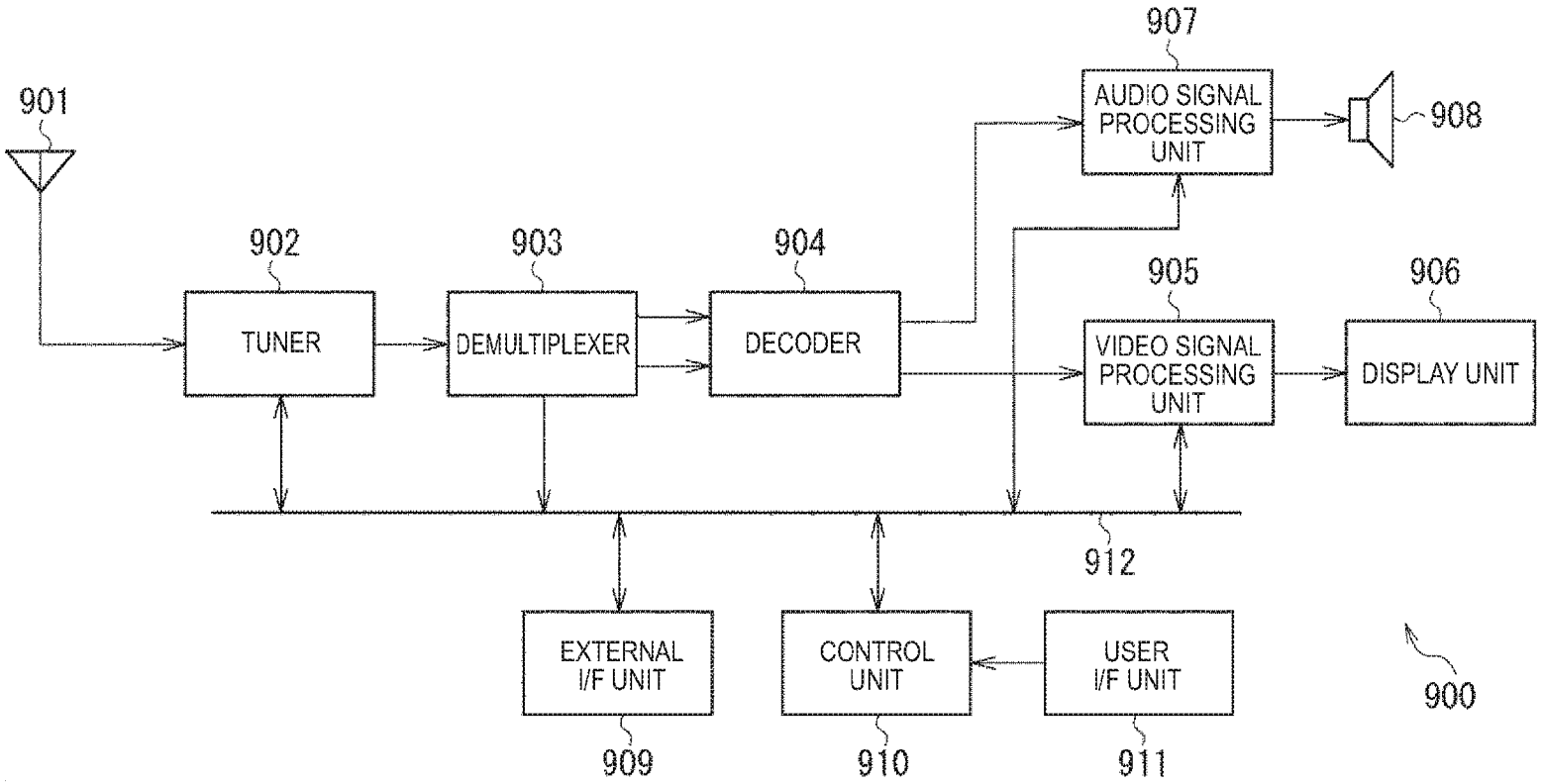
FIG. 15 is a diagram illustrating a schematic configuration example of a television apparatus to which the present disclosure is applied.

FIG. 15 illustrates a schematic configuration of a television apparatus to which the present disclosure is applied. The television apparatus 900 has an antenna 901, a tuner 902, a demultiplexer 903, a decoder 904, a video signal processing unit 905, a display unit 906, an audio signal processing unit 907, a speaker 908 and an external interface unit 909. Further, the television apparatus 900 has a control unit 910, a user interface unit 911, or the like.

The tuner 902 select a desired channel from broadcasting signals received at the antenna 901, performs demodulation and outputs obtained encoded bit streams to the demultiplexer 903.

The demultiplexer 903 extracts packets of video and sound of a program which is to be viewed from the encoded bit streams and outputs data of the extracted packets to the decoder 904. Further, the demultiplexer 903 supplies packets of data such as electronic program guide (EPG) to the control unit 910. Note that, when the packets are scrambled, the demultiplexer, or the like, descrambles the packets.

The decoder 904 performs decoding processing on the packets and outputs video data generated through the decoding processing to the video signal processing unit 905 and outputs the audio data to the audio signal processing unit 907.

The video signal processing unit 905 performs noise removal, video processing according to user setting, or the like, on the video data. The video signal processing unit 905 generates video data of a program to be displayed at the display unit 906, image data obtained through processing based on application supplied via a network, or the like. Further, the video signal processing unit 905 generates video data for displaying a menu screen, or the like, such as selection of an item and superimposes the video data on video data of the program. The video signal processing unit 905 generates a drive signal based on the video data generated in this manner to drive the display unit 906.

The display unit 906 drives a display device (such as, for example, a liquid crystal display element) based on the drive signal from the video signal processing unit 905 and displays video of the program, or the like.

The audio signal processing unit 907 performs predetermined processing such as noise removal on the audio data, and outputs sound by performing D/A conversion processing or amplification processing on the processed audio data and supplying the processed audio data to the speaker 908.

The external interface unit 909 which is an interface for connecting to external equipment or a network, transmits/receives data such as video data and audio data.

The user interface unit 911 is connected to the control unit 910. The user interface unit 911 which is configured with an operation switch, a remote control signal receiving unit, or the like, supplies an operation signal according to user operation to the control unit 910.

The control unit 910 is configured using a central processing unit (CPU), a memory, or the like. The memory stores a program executed by the CPU, various kinds of data required for the CPU to perform processing, EPG data, data acquired via a network, or the like. The program stored in the memory is read out by the CPU and executed at a predetermined timing such as upon activation of the television apparatus 900. The CPU controls each unit by executing the program so that the television apparatus 900 performs operation according to the user operation.

Note that, in the television apparatus 900, a bus 912 for connecting the tuner 902, the demultiplexer 903, the video signal processing unit 905, the audio signal processing unit 907, the external interface unit 909, or the like, to the control unit 910 is provided.

In the television apparatus configured as described above, functions of the image processing apparatus (image processing method) of the present application are provided at the video signal processing unit 905. Therefore, when power consumption of the display unit is reduced by reducing luminance of an image, it is possible to suppress degradation of image quality.

<Sixth Embodiment>

(Configuration Example of Mobile Phone)

Figure 16:
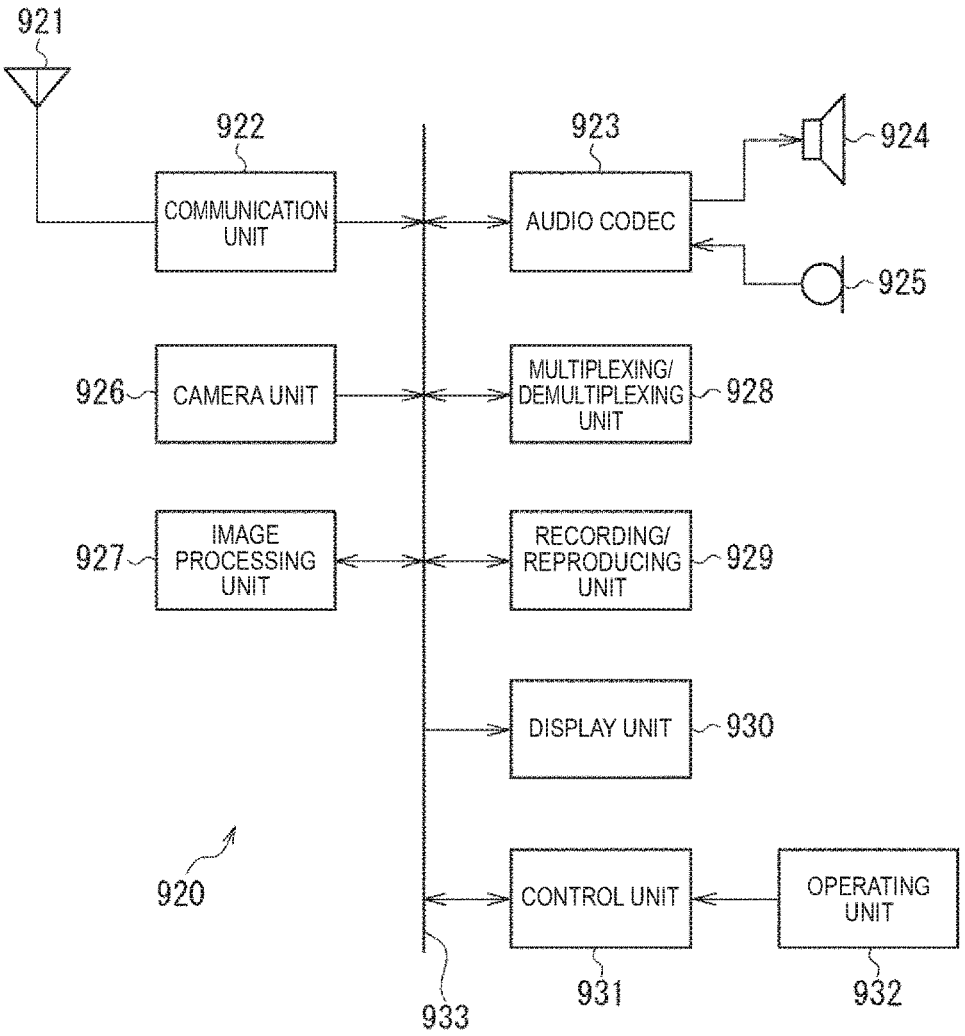
FIG. 16 is a diagram illustrating a schematic configuration example of a mobile phone to which the present disclosure is applied.

FIG. 16 illustrates a schematic configuration of a mobile phone to which the present disclosure is applied. The mobile phone 920 has a communication unit 922, an audio codec 923, a camera unit 926, an image processing unit 927, a multiplexing/demultiplexing unit 928, a recording/reproducing unit 929, a display unit 930 and a control unit 931. These are connected to one another via a bus 933.

Further, an antenna 921 is connected to the communication unit 922, and a speaker 924 and a microphone 925 are connected to the audio codec 923. Still further, an operating unit 932 is connected to the control unit 931.

The mobile phone 920 performs various kinds of operation such as transmission/reception of audio signals, transmission/reception of e-mails and image data, image photographing and data recording in various kinds of modes such as a speech phone call mode and a data communication mode.

In the speech phone call mode, an audio signal generated at the microphone 925 is converted into audio data or subjected to data compression at the audio codec 923 and supplied to the communication unit 922. The communication unit 922 performs modulation processing, frequency transform processing, or the like, on the audio data to generate a transmission signal. Further, the communication unit 922 supplies the transmission signal to the antenna 921 to transmit the transmission signal to a base station which is not illustrated. Still further, the communication unit 922 performs amplification or frequency transform processing and demodulation processing, or the like, on a received signal received at the antenna 921 and supplies the obtained audio data to the audio codec 923. The audio codec 923 performs data decompression of the audio data or converts the audio data into an analog audio signal and outputs the analog audio signal to the speaker 924.

Further, in the data communication mode, when an e-mail is transmitted, the control unit 931 accepts text data input through manipulation of the operating unit 932 and displays input text at the display unit 930. Further, the control unit 931 generates mail data based on a user instruction, or the like, at the operating unit 932 and supplies the mail data to the communication unit 922. The communication unit 922 performs modulation processing, frequency transform processing, or the like, on the mail data and transmits the obtained transmission signal from the antenna 921. Further, the communication unit 922 performs amplification or frequency transform processing and demodulation processing, or the like, on the received signal received at the antenna 921 to restore the mail data. This mail data is supplied to the display unit 930, where mail content is displayed.

Note that, the mobile phone 920 can store the received mail data in a storage medium at the recording/reproducing unit 929. The storage medium is, for example, a removable medium such as a semiconductor memory such as a RAM and a built-in flash memory, a hard disk, a magnetic disk, a magnetooptical disk, an optical disk, a universal serial bus (USB) memory and a memory card.

When image data is transmitted in the data communication mode, the image data generated at the camera unit 926 is supplied to the image processing unit 927. The image processing unit 927 performs encoding processing on the image data to generate encoded data.

The multiplexing/demultiplexing unit 928 multiplexes the encoded data generated at the image processing unit 927 and the audio data supplied from the audio codec 923 using a predetermined scheme and supplies the multiplexed data to the communication unit 922. The communication unit 922 performs modulation processing, frequency transform processing, or the like, on the multiplexed data and transmits the obtained transmission signal from the antenna 921. Further, the communication unit 922 performs amplification or frequency transform processing and demodulation processing, or the like, on the received signal received at the antenna 921 to restore the multiplexed data. This multiplexed data is supplied to the multiplexing/demultiplexing unit 928. The multiplexing/demultiplexing unit 928 demultiplexes the multiplexed data, supplies encoded data to the image processing unit 927 and supplies audio data to the audio codec 923. The image processing unit 927 performs decoding processing on the encoded data to generate image data. This image data is supplied to the display unit 930, where the received image is displayed. The audio codec 923 converts the audio data into an analog audio signal, supplies the analog audio signal to the speaker 924 and outputs the received sound.

In the mobile phone configured as described above, functions of the image processing apparatus (image processing method) of the present application are provided at the image processing unit 927. Therefore, when power consumption of the display unit is reduced by reducing the luminance of the image, it is possible to suppress degradation of image quality.

<Seventh Embodiment>

(Configuration Example of Recording/Reproducing Apparatus)

Figure 17:
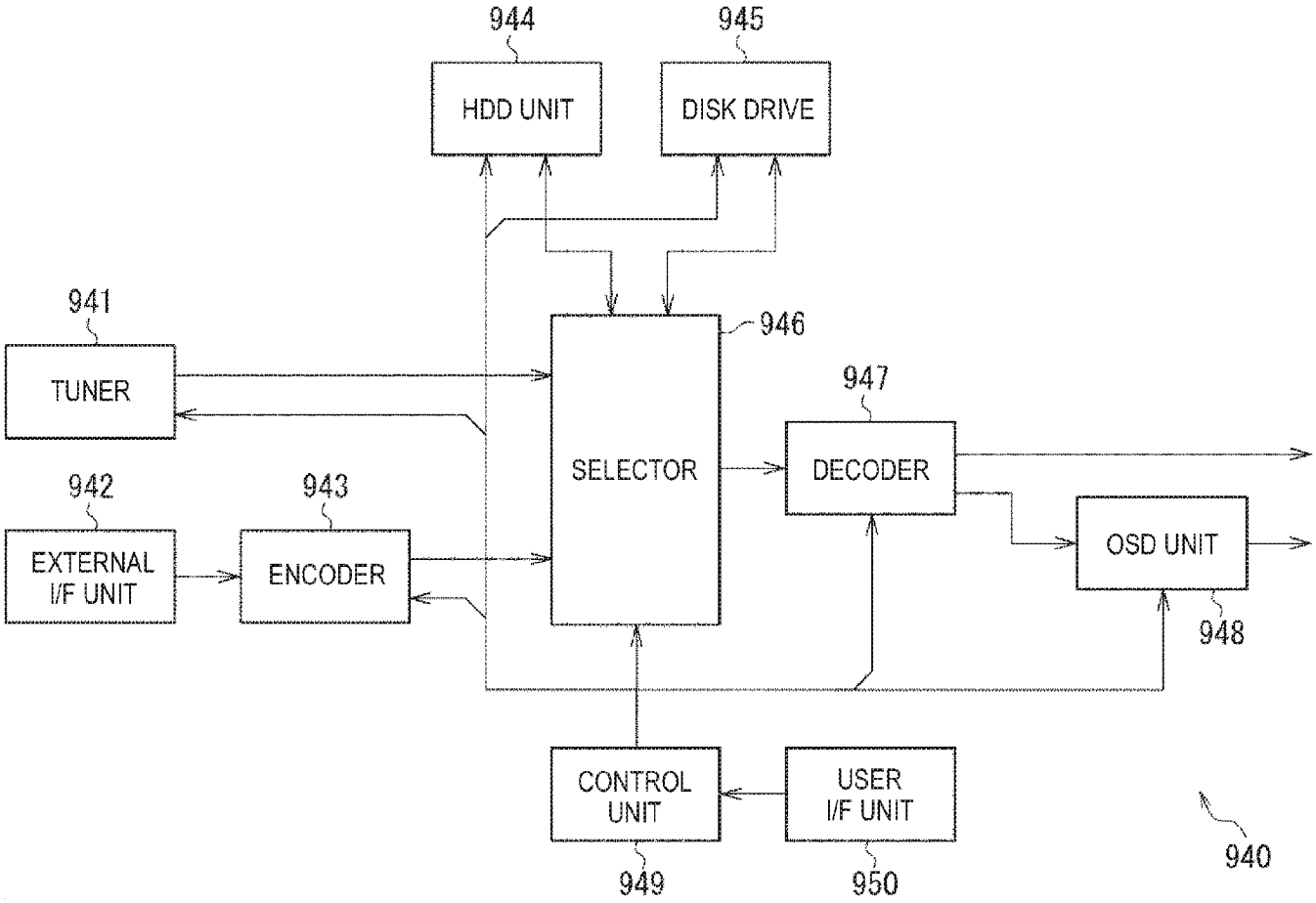
FIG. 17 is a diagram illustrating a schematic configuration example of a recording/reproducing apparatus to which the present disclosure is applied.
Figure 18:
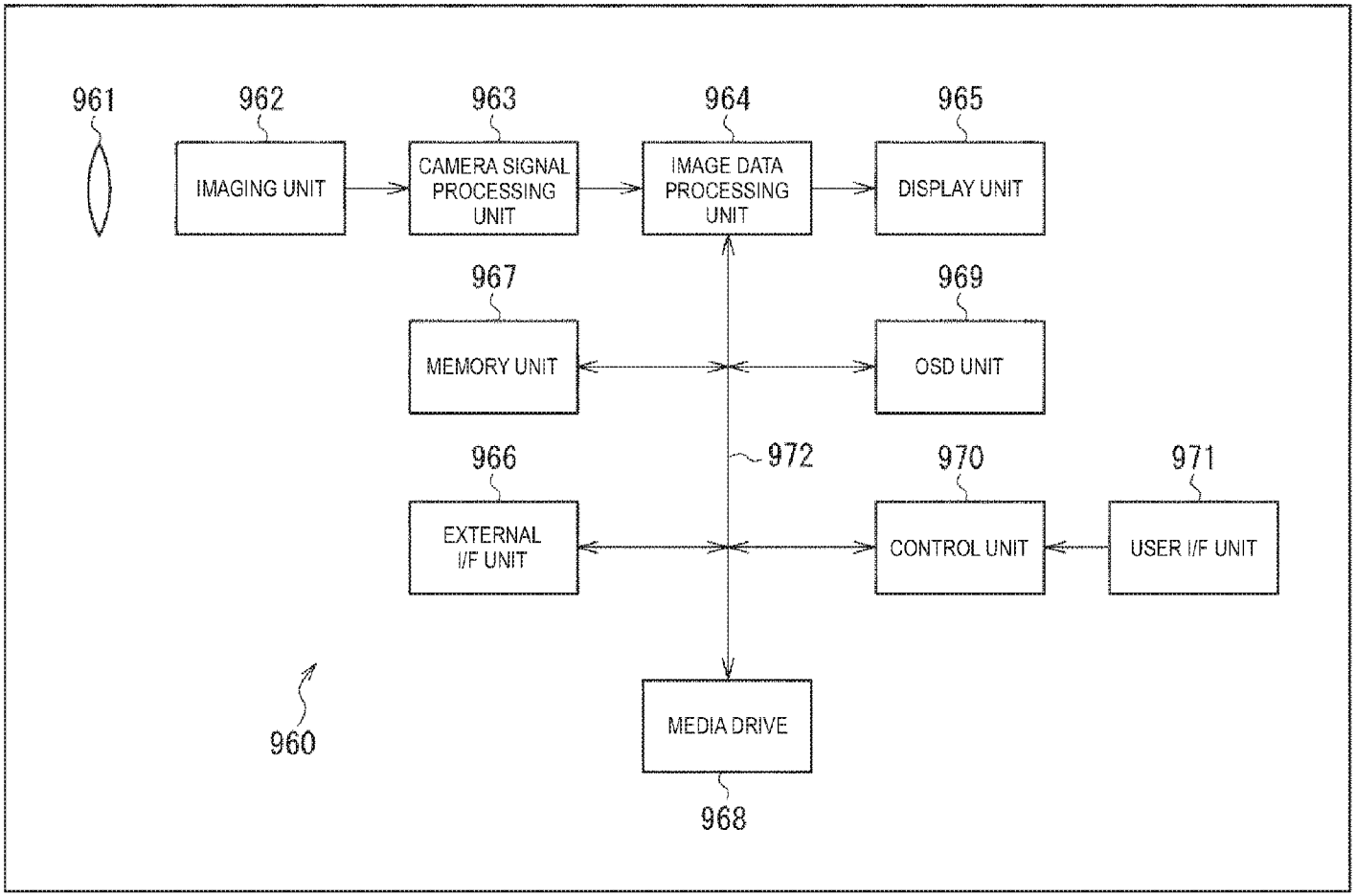
FIG. 18 is a diagram illustrating a schematic configuration example of an imaging apparatus to which the present disclosure is applied.

FIG. 17 illustrates a schematic configuration of a recording/reproducing apparatus to which the present disclosure is applied. The recording/reproducing apparatus 940, for example, records received audio data and video data of a broadcast program in a recording medium and provides the recorded data to the user at a timing according to the user's instruction. Further, the recording/reproducing apparatus 940, for example, can also acquire audio data and video data from other apparatuses and record these in the recording medium. Still further, the recording/reproducing apparatus 940 decodes the audio data and the video data recorded in the recording medium and outputs the decoded data, so that an image can be displayed and sound can be output at a monitor apparatus, or the like.

The recording/reproducing apparatus 940 has a tuner 941, an external interface unit 942, an encoder 943, a hard disk drive (HDD) unit 944, a disk drive 945, a selector 946, a decoder 947, an on-screen display (OSD) unit 948, a control unit 949 and a user interface unit 950.

The tuner 941 selects a desired channel from broadcast signals received at an antenna which is not illustrated. The tuner 941 outputs encoded bit streams obtained by demodulating a received signal of the desired channel to the selector 946.

The external interface unit 942 is configured with at least any of an IEEE1394 interface, a network interface unit, a USB interface, a flash memory interface, or the like. The external interface unit 942 which is an interface for connecting to external equipment, a network, a memory card, or the like, receives data such as video data and audio data to be recorded.

The encoder 943 performs encoding using a predetermined scheme when the video data and audio data supplied from the external interface unit 942 are not encoded and outputs encoded bit streams to the selector 946.

The HDD unit 944 records content data such as video and sound, various kinds of programs, other data, or the like, in a built-in hard disk and reads out these from the hard disk upon reproduction, or the like.

The disk drive 945 records and reproduces signals to the mounted optical disk. The optical disk is, for example, a DVD disk (such as DVD-Video, DVD-RAM, DVD-R, DVD-RW, DVD+R and DVD+RW), a Blu-ray (registered trademark) disk, or the like.

The selector 946 selects encoded bit streams from either the tuner 941 or the encoder 943 and supplies the encoded bit streams to either the HDD unit 944 or the disk drive 945 upon recording of video and sound. Further, the selector 946 supplies the encoded bit streams output from the HDD unit 944 or the disk drive 945 to the decoder 947 upon reproduction of video and sound.

The decoder 947 performs decoding processing of the encoded bit streams. The decoder 947 supplies video data generated by performing the decoding processing to the OSD unit 948. Further, the decoder 947 outputs audio data generated by performing the decoding processing.

The OSD unit 948 generates video data for displaying a menu screen, or the like, such as selection of an item, superimposes the video data on the video data output from the decoder 947 and outputs the superimposed video data.

The user interface unit 950 is connected to the control unit 949. The user interface unit 950 which is configured with an operation switch, a remote control signal receiving unit, or the like, supplies an operation signal according to user operation to the control unit 949.

The control unit 949 is configured using a CPU, a memory, or the like. The memory stores a program executed by the CPU and various kinds of data required for the CPU to perform processing. The program stored in the memory is read out from the CPU and executed at a predetermined timing such as upon activation of the recording/reproducing apparatus 940. The CPU controls each unit by executing the program so that the recording/reproducing apparatus 940 performs operation according to the user operation.

In the recording/reproducing apparatus configured as described above, functions of the image processing apparatus (image processing method) of the present application are provided at the decoder 947. Therefore, when power consumption of the display unit is reduced by reducing luminance of an image, it is possible to suppress degradation of image quality.

<Eighth Embodiment>

(Configuration Example of Imaging Apparatus)

FIG. 18 illustrates a schematic configuration of an imaging apparatus to which the present disclosure is applied. The imaging apparatus 960 images a subject and displays an image of the subject at the display unit or records the image in a recording medium as image data.

The imaging apparatus 960 has an optical block 961, an imaging unit 962, a camera signal processing unit 963, an image data processing unit 964, a display unit 965, an external interface unit 966, a memory unit 967, a media drive 968, an OSD unit 969 and a control unit 970. Further, a user interface unit 971 is connected to the control unit 970. Still further, the image processing unit 964, the external interface unit 966, the memory unit 967, the media drive 968, the OSD unit 969, the control unit 970, or the like, are connected via a bus 972.

The optical block 961 is configured using a focus lens, a diaphragm mechanism, or the like. The optical block 961 forms an optical image of the subject on an imaging surface of the imaging unit 962. The imaging unit 962 which is configured using a CCD or CMOS image sensor, generates an electric signal according to the optical image through photoelectric conversion and supplies the electric signal to the camera signal processing unit 963.

The camera signal processing unit 963 performs various camera signal processing such as knee correction, gamma correction and color correction on the electric signal supplied from the imaging unit 962. The camera signal processing unit 963 supplies image data subjected to the camera signal processing to the image data processing unit 964.

The image data processing unit 964 performs encoding processing on the image data supplied from the camera signal processing unit 963. The image data processing unit 964 supplies the encoded data generated through the encoding processing to the external interface unit 966 or the media drive 968. Further, the image data processing unit 964 performs decoding processing on the encoded data supplied from the external interface unit 966 or the media drive 968. The image data processing unit 964 supplies the image data generated through the decoding processing to the display unit 965. Further, the image data processing unit 964 performs processing of supplying the image data supplied from the camera signal processing unit 963 to the display unit 965, and superimposes data for display acquired from the OSD unit 969 on the image data and supplies the superimposed data to the display unit 965.

The OSD unit 969 generates data for display such as a menu screen including symbols, text or figures, and icons and outputs the display for image to the image data processing unit 964.

The external interface unit 966 is, for example, configured with a USB input/output terminal, or the like, and connected to a printer when an image is printed. Further, a drive is connected to the external interface unit 966 as necessary, and a removable medium such as a magnetic disk and an optical disk is mounted as appropriate, and a computer program read out from the removable medium is installed as necessary. Still further, the external interface unit 966 has a network interface connected to a predetermined network such as a LAN and the Internet. The control unit 970 can, for example, read out encoded data from the media drive 968 according to an instruction from the user interface unit 971 and supply the encoded data from the external interface unit 966 to other apparatuses connected via a network. Further, the control unit 970 can acquire encoded data or image data supplied from other apparatuses via a network through the external interface unit 966 and supply the data to the image data processing unit 964.

As a recording medium driven at the media drive 968, for example, a readable/writable arbitrary removable medium such as a magnetic disk, a magnetooptical disk, an optical disk and a semiconductor memory is used. Further, the recording medium includes an arbitrary type of removable media and may be a tape device, a disk or a memory card. Of course, the recording medium may be a non-contact integrated circuit (IC) card, or the like.

Further, the media drive 968 and the recording medium may be integrated and may be configured with a non-portable storage medium such as, for example, a built-in hard disk drive and a solid state drive (SSD).

The control unit 970 is configured using a CPU. The memory unit 967 stores a program executed by the control unit 970, various kinds of data required for the control unit 970 to perform processing, or the like. The program stored in the memory unit 967 is read out and executed by the control unit 970 at a predetermined timing such as upon activation of the imaging apparatus 960. The control unit 970 controls each unit by executing the program so that the imaging apparatus 960 performs operation according to user operation.

In the imaging apparatus configured as described above, functions of the image processing apparatus (image processing method) of the present application are provided at the image data processing unit 964. Therefore, when power consumption of the display unit is reduced by reducing luminance of an image, it is possible to suppress degradation of image quality.

In addition, the effects described in the present specification are not limiting but are merely examples, and there may be additional effects.

An embodiment of the disclosure is not limited to the embodiments described above, and various changes and modifications may be made without departing from the scope of the disclosure.

For example, the present disclosure can adopt a configuration of cloud computing which processes by allocating and connecting one function by a plurality of apparatuses through a network.

Further, each step described by the above-mentioned flowcharts can be executed by one apparatus or by allocating a plurality of apparatuses.

In addition, in the case where a plurality of processes are included in one step, the plurality of processes included in this one step can be executed by one apparatus or by sharing a plurality of apparatuses.

Additionally, the present technology may also be configured as below.

(1)

An image processing apparatus including:

a determining unit configured to determine a reduction amount of luminance of a pixel based on characteristics of each pixel of an image; and a reducing unit configured to reduce the luminance of the pixel by the reduction amount determined by the determining unit.

(2)

The image processing apparatus according to (1), wherein the determining unit determines the reduction amount based on data relating to display of the image and the characteristics.

(3)

The image processing apparatus according to (1) or (2), further including:

an amplifying unit configured to amplify an alternating current (AC) component of the image, wherein the reducing unit reduces the luminance of the pixel of the image whose AC component is amplified by the amplifying unit by the reduction amount.

(4)

The image processing apparatus according to (3), wherein the amplifying unit amplifies the AC component with a gain based on data relating to display of the image.

(5)

The image processing apparatus according to (3) or (4), wherein the amplifying unit amplifies the AC component using a quadratic differential filter.

(6)

The image processing apparatus according to (3) or (4), wherein the amplifying unit amplifies the AC component based on polarity of a quadratic differential of the image.

(7)

The image processing apparatus according to (3) or (4), wherein the amplifying unit amplifies the AC component based on a first differential waveform of the image.

(8)

The image processing apparatus according to any one of (1) to (7), wherein the reducing unit performs the reduction according to an operation mode.

(9)

The image processing apparatus according to any one of (1) to (8), further including:

an extracting unit configured to extract characteristics of each pixel of the image, wherein the determining unit determines the reduction amount of the pixel based on the characteristics of each pixel of the image extracted by the extracting unit.

(10)

An image processing method executed by an image processing apparatus, the image processing method including:

a determination step of determining a reduction amount of luminance of a pixel based on characteristics of each pixel of an image; and a reduction step of reducing the luminance of the pixel by the reduction amount determined through processing of the determination step.

(11)

A program for causing a computer to function as:

a determining unit configured to determine a reduction amount of luminance of a pixel based on characteristics of each pixel of an image; and a reducing unit configured to reduce the luminance of the pixel by the reduction amount determined by the determining unit.

REFERENCE SIGNS LIST

10 image processing apparatus
11 extracting unit
12 determining unit
13 reducing unit
31 amplifying unit
50 image processing apparatus

The invention claimed is:

1. An image processing apparatus, comprising:

circuitry configured to:

determine a reduction amount of luminance of a pixel of an image based on characteristics of each of a plurality of pixels of the image;

amplify an alternating current (AC) component of the luminance of the pixel; and reduce the luminance of the pixel by the determined reduction amount based on the amplified AC component of the luminance of the pixel.

2. The image processing apparatus according to claim 1, wherein the circuitry is further configured to determine the reduction amount based on data associated with display of the image and the characteristics of each of the plurality of pixels of the image.

3. The image processing apparatus according to claim 1, wherein the circuitry is further configured to amplify the alternating current AC component of the image by an amount equal to the determined reduction amount.

4. The image processing apparatus according to claim 3, wherein the circuitry is further configured to amplify the AC component with a gain based on data associated with display of the image.

5. The image processing apparatus according to claim 3, wherein the circuitry is further configured to amplify the AC component based on a quadratic differential filter.

6. The image processing apparatus according to claim 3, wherein the circuitry is further configured to amplify the AC component based on polarity of a quadratic differential of the image.

7. The image processing apparatus according to claim 3, wherein the circuitry is further configured to amplify the AC component based on a first differential waveform of the image.

8. The image processing apparatus according to claim 1, wherein the circuitry is further configured to reduce the luminance of the pixel based on an operation mode of the image processing apparatus.

9. The image processing apparatus according to claim 1, wherein the circuitry is further configured to:

extract the characteristics of each of the plurality of pixels of the image; and determine the reduction amount based on the extracted characteristics of each of the plurality of pixels of the image.

10. An image processing method, comprising:

determining a reduction amount of luminance of a pixel of an image based on characteristics of each of a plurality of pixels of the image;

amplifying an alternating current (AC) component of the luminance of the pixel; and reducing the luminance of the pixel by the determined reduction amount based on the amplified AC component of the luminance of the pixel.

11. A non-transitory computer-readable medium having stored thereon computer-executable instructions which, when executed by a computer, cause the computer to execute operations, the operations comprising:

determining a reduction amount of luminance of a pixel of an image based on characteristics of each of a plurality of pixels of the image;

amplifying an alternating current (AC) component of the luminance of the pixel; and reducing the luminance of the pixel by the determined reduction amount based on the amplified AC component of the luminance of the pixel.

12. The image processing apparatus according to claim 1, wherein the circuitry is further configured to reduce the luminance of the pixel based on a uniform multiplication of the image by a gain less than unity.

* * * * *